US005222053A

United States Patent [19]

Ohhira

[11] Patent Number: 5,222,053

[45] Date of Patent: Jun. 22, 1993

[54] ANALOG ELECTRONIC WATCH WITH AN ELECTRO-OPTICAL DISPLAY DEVICE

[75] Inventor: Tatsuo Ohhira, Akishima, Japan

[73] Assignee: Casio Computer Co., Ltd., Tokyo, Japan

[21] Appl. No.: 782,642

[22] Filed: Oct. 25, 1991

[30] Foreign Application Priority Data

Nov. 8, 1990 [JP] Japan ..... 2-301177

[51] Int. Cl.[5] ..... G04B 23/02; G04B 19/04

[52] U.S. Cl. ..... 368/73; 368/80; 368/82; 368/228; 368/250

[58] Field of Search ..... 368/72-74, 368/75, 76, 77, 80, 82, 223 J, 228, 229, 231-233, 250, 251, 272-273

[56] References Cited

U.S. PATENT DOCUMENTS

| | | | |
|---|---|---|---|
| 4,043,116 | 8/1977 | Schlappi | 368/77 |
| 4,257,115 | 3/1981 | Hatuse et al. | 368/69 |
| 4,262,345 | 4/1981 | Ganter et al. | 368/29 |
| 4,396,294 | 8/1983 | Yoshida | 368/71 |
| 4,413,915 | 11/1983 | Besson | 368/71 |
| 4,436,435 | 3/1984 | Ushikoshi | 368/71 |
| 4,470,708 | 9/1984 | Nee | 368/276 |
| 4,488,818 | 12/1984 | Saurer et al. | 368/71 |
| 4,697,931 | 10/1987 | Okuyama et al. | 368/223 |

FOREIGN PATENT DOCUMENTS

| | | |
|---|---|---|
| 1921563 | 10/1970 | Fed. Rep. of Germany . |
| 2247258 | 4/1973 | Fed. Rep. of Germany . |
| 1-91291 | 6/1989 | Japan . |
| 1-242987 | 9/1989 | Japan . |
| 2052115 | 1/1981 | United Kingdom . |

OTHER PUBLICATIONS

Patent Abstracts of Japan, vol. 14, No. 029, Oct. 20, 1989 Citizen Watch Co., Ltd., Kato Yoshiaki, Composite Display Electronic Time-Piece.

Patent Abstracts of Japan, vol. 135, No. 000, Dec., 1989 Combined Display Electronic Timepiece, Ichikawa Shingo.

*Primary Examiner*—Vit W. Miska

*Attorney, Agent, or Firm*—Frishauf, Holtz, Goodman & Woodward

[57] ABSTRACT

An analog electronic watch includes a dial provided with a window, an electro-optical display device arranged below the window, and a shutter plate, movably arranged between the dial and the electro-optical display device, for opening and closing the window. The shutter plate is moved at a preset time to expose the electro-optical display device through the window of the dial, so that an alarm information displayed on the electro-optical display device becomes visible from outside.

33 Claims, 16 Drawing Sheets

ANALOG ELECTRONIC WATCH WITH AN ELECTRO-OPTICAL DISPLAY DEVICE

BACKGROUND OF THE INVENTION

1. Field of the Invention

This invention relates to an analog electronic watch provided with an electro-optical display device for displaying data.

2. Description of the Related Art

A multi-functional analog electronic watch provided with an analog type time display device and a liquid crystal display device is already known. Such a watch can selectively display pieces of information including the current date, a registered time for alarm, a measured time by a stopwatch function, a schedule, telephone numbers and so on on the liquid crystal display.

The appearance of an analog watch of this type is spoiled because the liquid crystal display is exposed even when no such information is displayed.

In order to avoid this problem, there has been proposed in Published and Unexamined Japanese Patent Application No. 1-242987 and Published and Unexamined Japanese utility Model application No. 1-91291 an analog electronic watch having a dial provided with a window, which is closed by a shutter and below which a liquid crystal display is arranged. The window can be opened to expose the liquid crystal display by moving the shutter aside by means of a switch-operated pulse motor only when the liquid crystal display is used.

Some of known electronic watches of the types, each having an analog type time display device and a liquid crystal display that always digitally display the current time, function to emit an alarm sound at a preset time and to display a schedule information at the preset time on the liquid crystal display. In such a case that the above described known electronic watch is further provided with a shutter as described above, it emits an alarm sound at a preset time but the window remains closed. Therefore, the shutter should be moved by additionally operating the switch in order for the bearer of the watch to see the information displayed on the liquid crystal display.

SUMMARY OF THE INVENTION

It is, therefore, the object of the present invention to provide an analog electronic watch provided with an electro-optical display which is normally veiled to maintain the good appearance of the watch and is automatically exposed the electro-optical display at an alarm time to prevent the watch bearer from forgetting to look information displayed on the display at the alarm time.

In order to achieve the above described object, an analog electronic watch with an electro-optical display device of this invention comprises: a dial provided with a window; analog type time display means for displaying time by rotating hands on said dial; electro-optical display means, arranged below said window, for displaying alarm information; a shutter plate, movably arranged between said dial and said electro-optical display means, for opening or closing the window on said dial; and shutter-plate movement control means for controlling the movement of said shutter to expose said electro-optical display means through said window at a preset alarm time by moving said shutter plate from its closed position to its open position.

With an arrangement as described above, the electro-optical display device of an analog electronic watch according to the invention normally remains invisible from outside and, therefore, the good appearance of the watch is kept. At a preset alarm time, the electro-optical display device of the watch is automatically exposed so that the bearer of the watch can easily look the information displayed on the display and is prevented from forgetting to look the information.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

(1) First Embodiment

Now, a first embodiment of the invention will be described by referring to FIGS. 1A through 9.

a) Construction

Figure 1A:
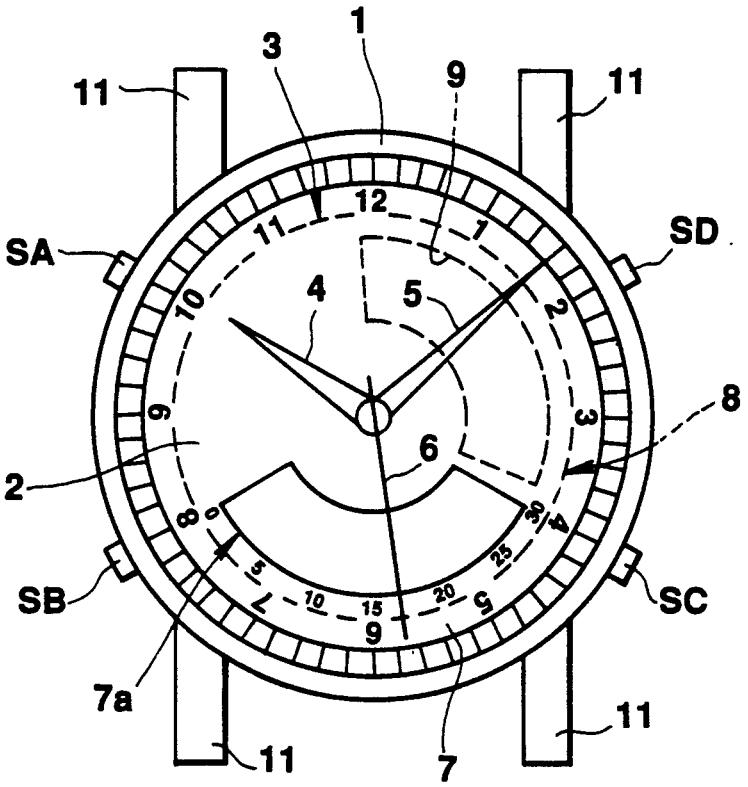
FIG. 1A is a plan view of an electronic wrist watch of a first embodiment according to the invention with its shutter plate in a closed position.
Figure 1C:
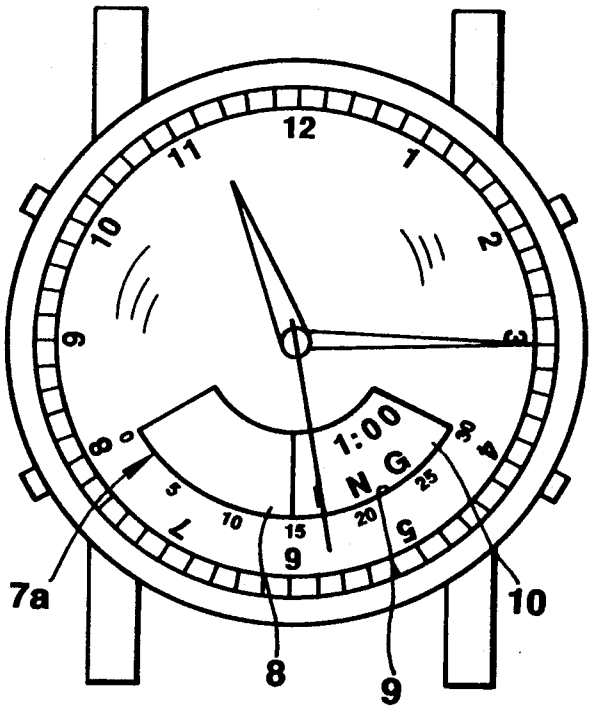
FIG. 1C is a plan view of the electronic wrist watch of FIG. 1A with its shutter plate in a half closed position.
Figure 1B:
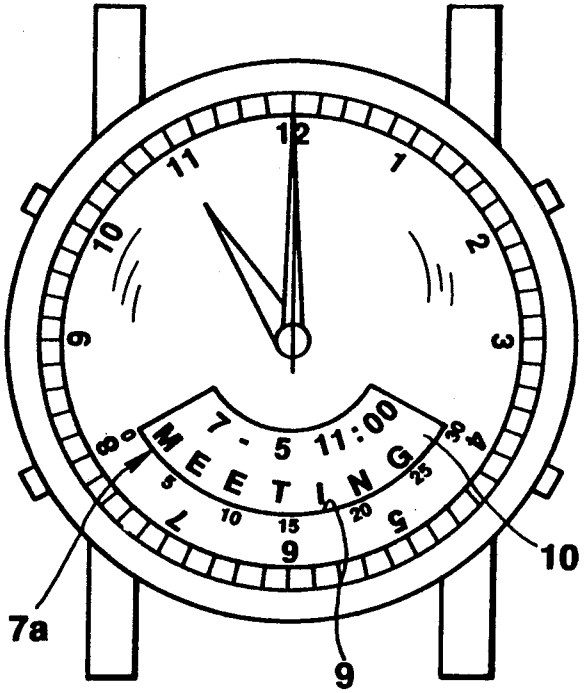
FIG. 1B is a plan view of the electronic wrist watch of FIG. 1A with its shutter plate in an open position.

FIGS. 1A through 1C show the appearances of the embodiment under three different conditions. As seen from FIG. 1A, an analog display portion 3 covered by a watch glass 2 is arranged at a front surface of a watch case 1, and an hour hand 4, a minute hand 5, a second hand 6 and a dial 7 are mounted in the analog display portion 3. An arc-shaped display window portion 7a extending within a rotational angle of 120° around the pivotal point of the hands is formed in the dial 7. A liquid crystal display panel 10 having substantially the same shape as that of the display window portion 7a is arranged below the display window portion 7a so that the liquid crystal display panel 10 can be seen through the display window portion 7a. A disc-shaped shutter plate 8 is arranged between the dial 7 and the liquid crystal display panel 10 as indicated by a broken line in FIG. 1A so as to rotate concentrically to the pivotal point of the hands. In the shutter plate 8, an opening portion 9 having the same shape as those of the display window portion 7a of the dial 7 and the liquid crystal display panel 10 is formed. When the shutter plate 8 is rotated and overlaps its opening portion 9 with the display window portion 7a of the dial 7, the liquid crystal display panel 10 is exposed.

Four push button switches SA, SB, SC and SD and a pair of band attaching portions 11 are mounted on an outer periphery of the watch case 1.

In this embodiment, the display window portion 7a of the dial 7 is closed by the shutter plate 8 until a pre-set scheduled time comes so that the liquid crystal display panel 10 can not been seen from outside, as illustrated in FIG. 1A. When the pre-set scheduled time arrives, an alarm sound is produced for a minute and, at the same time, the shutter plate 8 is rotated to overlap the opening portion 9 of the shutter plate with the display window portion 7a and to expose the liquid crystal display panel 10 through the opening portion 9 and the display window portion 7a, as illustrated in FIG. 1B. The liquid crystal display panel 10 displays a schedule information related to the scheduled time. From the scheduled time, the shutter plate 8 rotates in a counterclockwise direction at a rate of 4° per minute so that the display window portion 7a is gradually closed from its left edge by the shutter plate 8. When 15 minutes have passed from the scheduled time, a left half of the display window portion 7a is closed and a right half of the display window portion 7a remains visible from outside as shown in FIG. 1C. The display window portion 7a will be completely closed when 30 minutes have passed after the scheduled time. In order to easily recognize the time that has passed since the scheduled time by the extent of closing the display window portion 7a with the shutter plate 8, numbers 0, 5, 10, 15, 20, 25 and 30 representing respectively elapsed minutes since the scheduled time are printed on the dial 7 along the outer peripheral edge of the display window portion 7a.

Since the outer surface of the shutter plate 8 is painted by the same color as that of the outer surface of the dial 7, the existence of the display window portion 7a may be totally unnoticed so long as the display window portion 7a is closed by the shutter plate 8.

Figure 2:
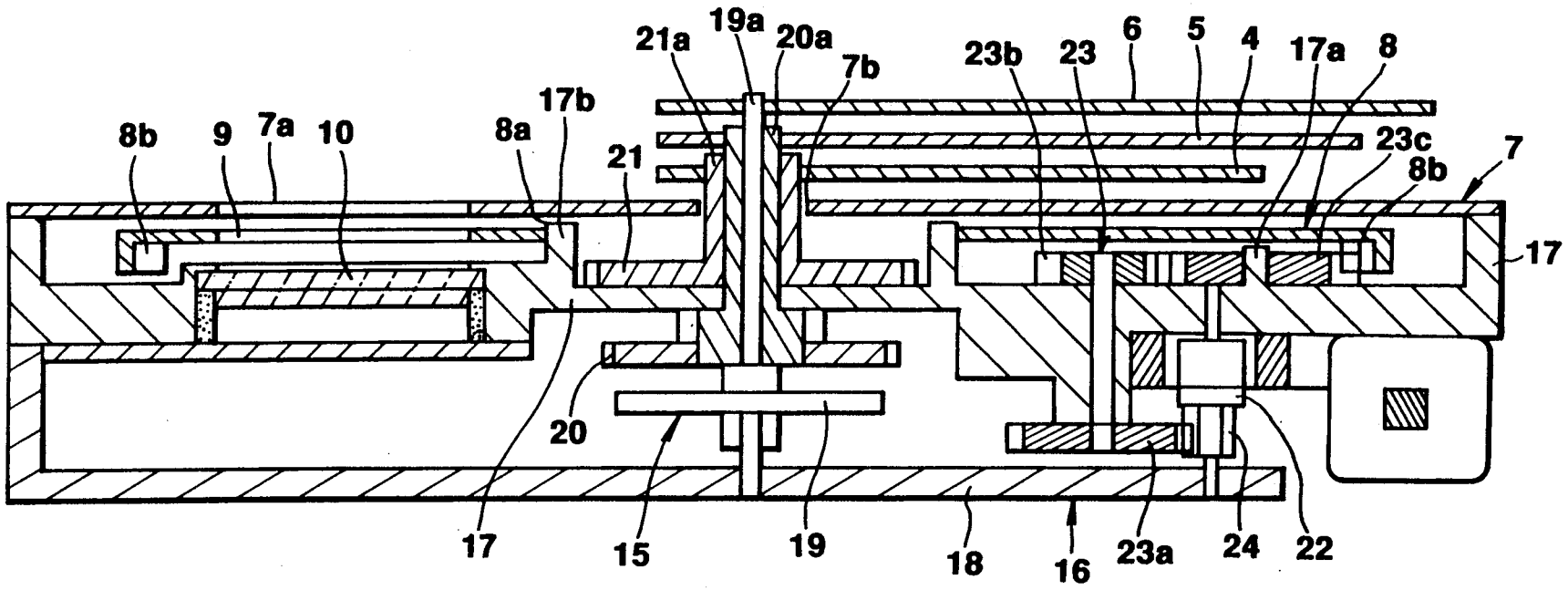
FIG. 2 is a sectional view of a main portion of the electronic wrist watch of FIGS. 1A through 1C.

FIG. 2 shows a sectional view of a main portion of an analog movement in the watch case 1. The analog movement is constructed by a gear train mechanism 15 and a shutter drive device 16. The gear train mechanism 15 is driven by a hand driving stepping motor (not shown) to move the hour hand 4, the minute hand 5, and the second hand 6 and to designate time by these hands. In this gear train mechanism 15, a second wheel 19 is rotatably arranged between a main plate 17 and a bearing plate 18, and a center wheel 20 is rotatably fitted on a shaft 19a of the second wheel 19, while an hour wheel 21 is rotatably fitted on a sleeve shaft 20a of the center wheel 20. The second wheel 19 is used to move the second hand 6, and the shaft 19a projects upward from the main plate 17, to the upper end of which the second hand 6 is rigidly fitted. The rotational force from the stepping motor is transmitted to the second wheel 19 through a fifth wheel (not shown) to drive the second hand 6. The center wheel 20 is used to move the minute hand 5, and its sleeve shaft 20a projects upward from the main plate 17, to the upper end of which the minute hand 5 is rigidly fitted. The rotation of the second wheel 19 is transmitted to the center wheel 20 through a third wheel (not shown) to drive the minute hand 5. The hour wheel 21 is used to move the hour hand 4 which is rigidly fitted to the upper end of its sleeve shaft 21a. The rotation of the center wheel 20 is transmitted to the hour wheel 21 through a minute wheel (now shown) to drive the hour hand 4.

The shutter drive device 16 is used to rotate the shutter plate 8, and is constructed by a shutter driving stepping motor 22 attached to the main plate 17 and a gear train mechanism 23. The train mechanism 23 is constructed by a first gear wheel 23a engaged with a rotor pinion 24 of the shutter driving stepping motor 22, a second gear wheel 23b rigidly fitted to the shaft 20 of the first gear wheel 23a, and a third gear wheel 23c rotatably fitted on a projection 17a of the main plate 17 and meshed with the second gear wheel 23b.

The dial 7 is fixed to an upper end of a peripheral wall of the main plate 17, and the shutter plate 8 is arranged below the dial 7 so as to be coaxially rotatable to the pivotal center of the hands. The liquid crystal display panel 10, having a wide arc shape extending in a rotational angle of 120° as described above, is arranged below the shutter plate 8. The dial 7 has a through bore 7b at its center, through which the sleeve shaft 21a of the hour wheel 21, the sleeve shaft 20a of the minute wheel 20 and the shaft 19a of the second wheel 19 are passed. Further, a display window portion 7a having the same shape as that of the liquid crystal display panel 10 is formed in the dial 7 to be coaxial with the through bore 7b and to be overlapped with the liquid crystal display panel 10. The shutter plate 8 has a disc shape, and a through bore 8a is formed in its center, into which a hollow cylindrical projecting portion 17b formed on the upper surface of the main plate 17 to be coaxial with the pivotal center the hands is inserted. In the shutter plate 8, the above described opening portion 9 shown in FIG. 1A is further formed to be concentric with the center of the through bore 8a. An internal gear wheel 8b is arranged at the outer periphery on the lower surface of the shutter plate 8 and is meshed with the third gear wheel 23c of the gear train mechanism 23 of the shutter drive device 16. Thus, when the shutter driving stepping motor 22 rotates its output shaft, the rotation of the motor is transmitted to the inner wheel gear 8*b* of the shutter plate 8 through the rotor pinion 24, and the first gear wheel 23*a*, the second gear wheel 23*b* and the third gear wheel 23*c* of the gear train mechanism 23 to rotate the shutter plate 8, so that the display window portion 7*a* of the dial 7 is intermittently opened and closed as the shutter plate 8 is rotated.

Figure 3:
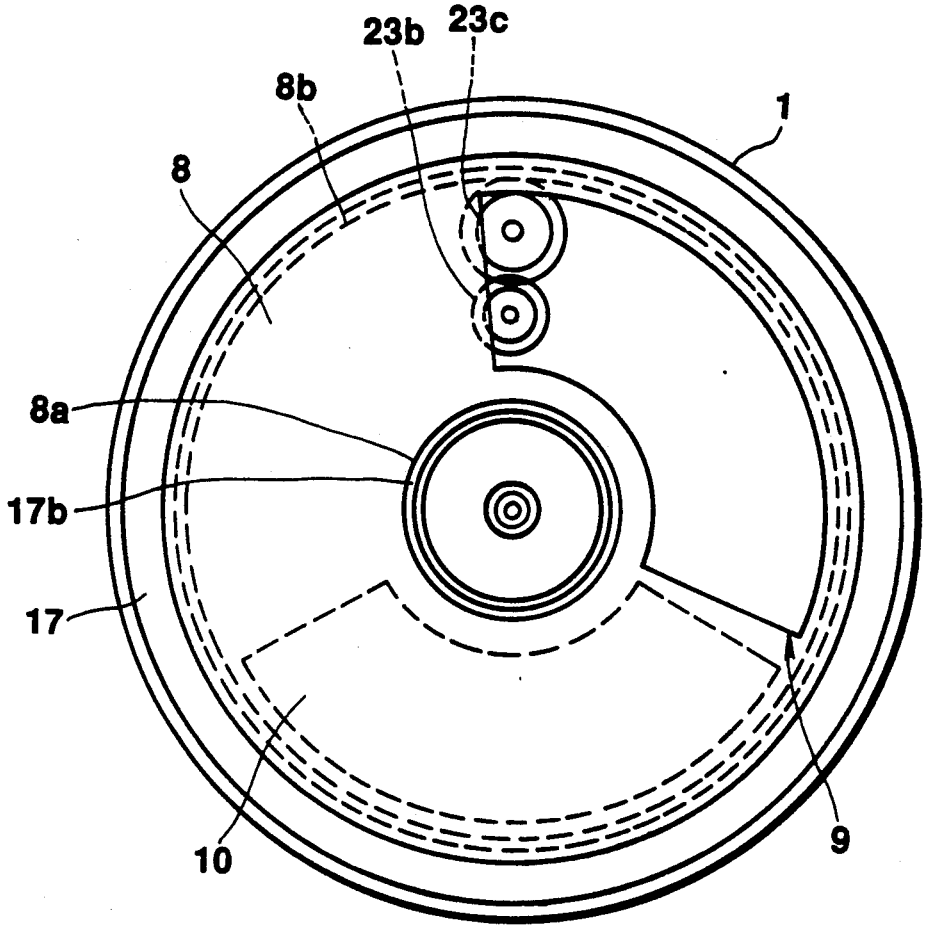
FIG. 3 is a plan view of a mechanism for moving the shutter plate of the electronic wrist watch of FIGS. 1A through 1C.

FIG. 3 illustrates a relation-ship among the shutter plate 8, the liquid crystal display panel 10 and other related components, where the hour hand 4, the minute hand 5 and the second hand 6 as well as the dial 7 are taken away from the watch of FIG. 1A. Here, the shutter plate 8 is rotatable around the hollow cylindrical projecting portion 17*b* of the main plate 17 in the watch case 1 as the through bore 8*a* of the shutter plate 8 is fitted on the projecting portion 17*b*. Since the internal wheel gear 8*b* arranged at the outer periphery on the lower surface of the shutter plate 8 meshes with the third wheel gear 23*c* of the gear train mechanism 23 of the shutter drive device 16, the shutter plate 8 is rotated to move the angular position of the opening portion 9 of the shutter plate 8 when the shutter driving stepping motor 22 rotates it output shaft. Thus, when the opening portion 9 of the shutter plate 8 overlaps the liquid crystal display panel 10 fixed to the mainplate 17 in the back side of the shutter plate 8, the display surface of the liquid crystal display panel 10 becomes clearly visible from outside.

Figure 4:
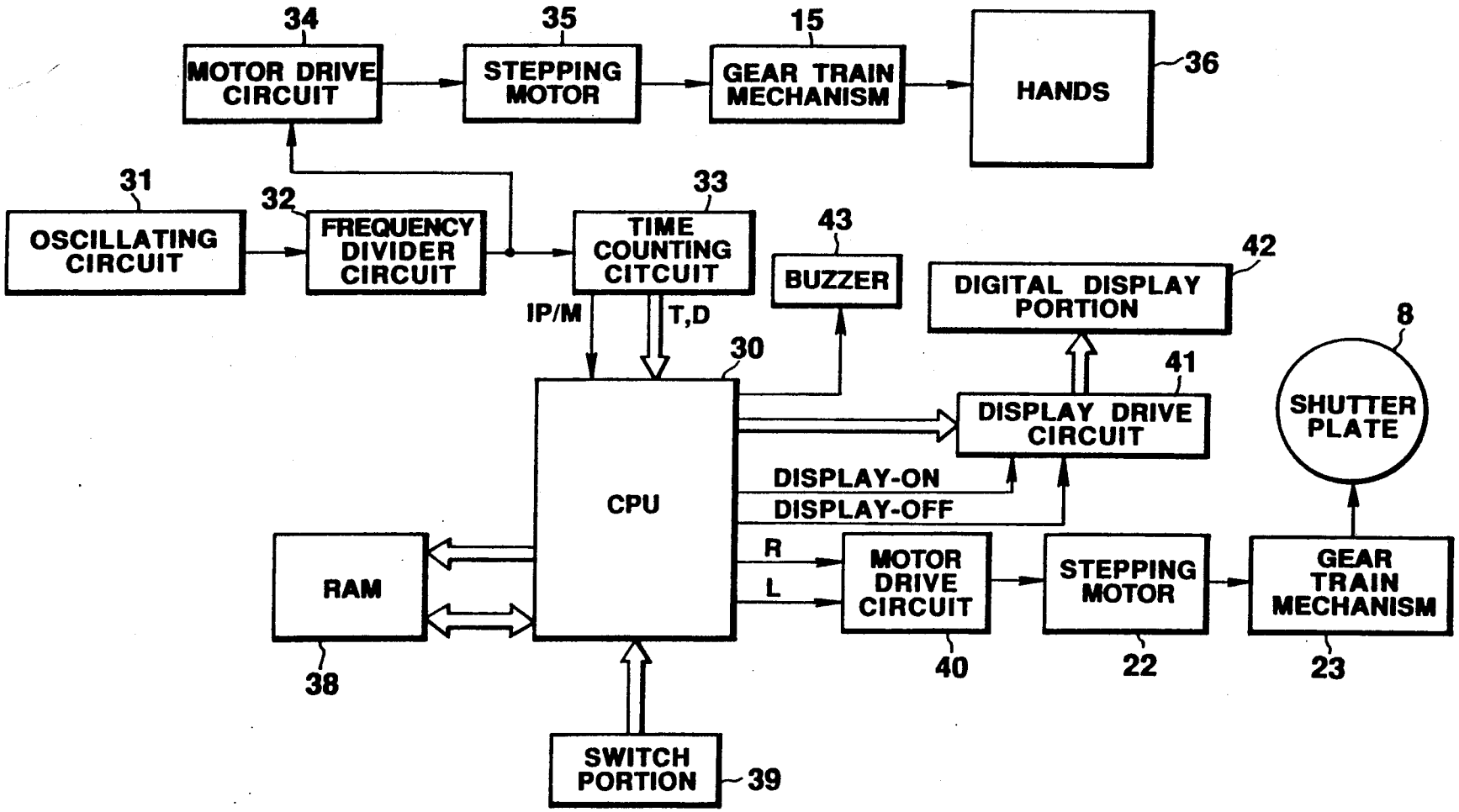
FIG. 4 is a block diagram of a circuit of the electronic wrist watch of FIGS. 1A through 1C.

FIG. 4 is a block diagram of a circuit of the electronic watch of the first embodiment, where various function modules are connected to a CPU 30. The CPU 30 processes data supplied thereto and transmits signals to the various function modules to control them.

An oscillating circuit 31 constantly sends out a signal having a constant frequency. A frequency divider circuit 32 divides the signal from the oscillating circuit 31 to a specified frequency and transmits the frequency-divided signals to a time counting circuit 33 and a motor drive circuit 34. The time counting circuit 33 counts the frequency-divided signals from the frequency divider circuit 32 to obtain current time signals T and current date signals D, and sends them to the CPU 30. It also sends to the CPU 30 a one-minute signal (1P/M signal) per minute.

The motor drive circuit 34 controls a stepping motor 35 to rotate its output shaft on the basis of the frequency-divided signals from the frequency divider circuit 32. The stepping motor 35 drived by the motor drive circuit 34 transmits it rotational force to hands 36 through the gear train mechanism 15, and moves the hands 36.

A RAM 38 stores data transmitted from the CPU 30 and transmits data stored therein to the CPU 30, under the control of the CPU 30. A switch portion 39 comprises the push buttons SA, SB, SC and SD which are described earlier and, when one of the switches is operated, it transmits a corresponding switch input signal to the CPU 30.

A motor drive circuit 40 generates a drive signal for controlling the shutter driving stepping motor 22 to rotate its output shaft in a forward or a reverse direction by one step at each time when the motor 22 receives a forward rotation signal R or a reverse rotation signal L. The rotational force from the shutter driving stepping motor 22 is transmitted to the shutter plate 8 through the gear train mechanism 23 to rotate the shutter plate 8. In this case, when the step motor 22 rotates forwardly or reversely its output shaft by one step, the shutter plate 8 rotates forwardly (clockwise) or reversely (counterclockwise) by 4° (or 120°/30). A display drive circuit 41 is operated by receiving a display ON signal from the CPU 30 to cause data transmitted from the CPU 30 to be displayed on the liquid crystal display panel 10 of a digital display portion 42. By receiving OFF signal from the CPU 30, the circuit 41 stops its operation. A buzzer 43 produces an alarm sound upon receiving an alarm sound producing signal from the CPU 30.

Figure 5:
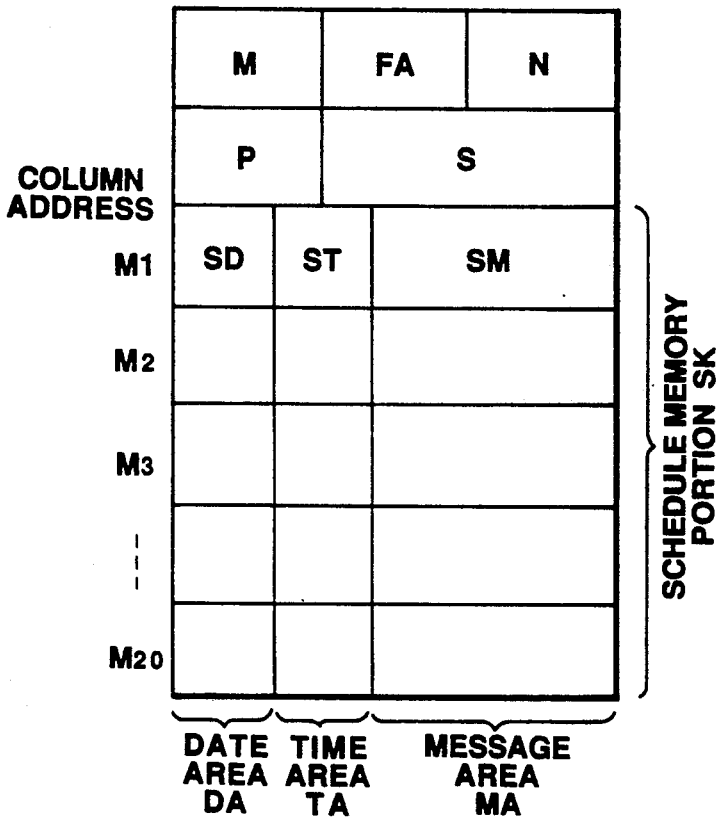
FIG. 5 is a schematic illustration of a construction of a RAM 38 in FIG. 4.

FIG. 5 illustrates the construction of the RAM 38. A mode register M is used to designate a mode. When 0 is set in the mode register M, it designate a watch mode in which the display window portion 7*a* is closed by the shutter plate 8 and the current time is displayed by the hands 36. When 1 is set in the mode register M1, it designates a schedule mode in which schedule information which have not reached at their corresponding scheduled times are displayed on the liquid crystal display panel 10 to be confirmed. A state register FA is used to indicate various states. When a scheduled time has arrived and an alarm sound being produced, 1 is set in the register FA. While 30 minutes in which the display window portion 7*a* is gradually shut by the shutter plate 8 after the alarm sound lasted for one minute, 2 is set in the register FA. Further, in the other state, 0 is set. In a next schedule register N, a column address, which relates to a schedule information in the most near future among the schedule informations in a schedule memory portion SK, is set. A register P designates a column address corresponding to a schedule information to be displayed on the digital display portion 42 in the schedule informations stored in the schedule memory portion SK. The number of steps that corresponds to the degree of closure of the display window portion 7*a* by the shutter plate 8 is set in a shutter position register S. More specifically, 30 is set in the register S when the display window portion 7*a* is fully open, 0 is set when the window portion 7*a* is completely closed, and an appropriate number between 30 and 0 is set to indicate an appropriate condition between the fully opening condition and the fully closed condition (e.g., 5 is set when only one sixth of the display window portion 7*a* is open, and 15 is set when the display window portion 7*a* is half closed).

The schedule memory portion SK is composed of 20 columns, to which column addresses M1 through M20 are allocated. Each column is composed of a date area DA, a time area TA and a message area MA for storing the date and time and message for each schedule corresponding to each line respectively. A schedule information which has an earlier date and an earlier time is stored in a smaller column address.

b) Action

Figure 6:
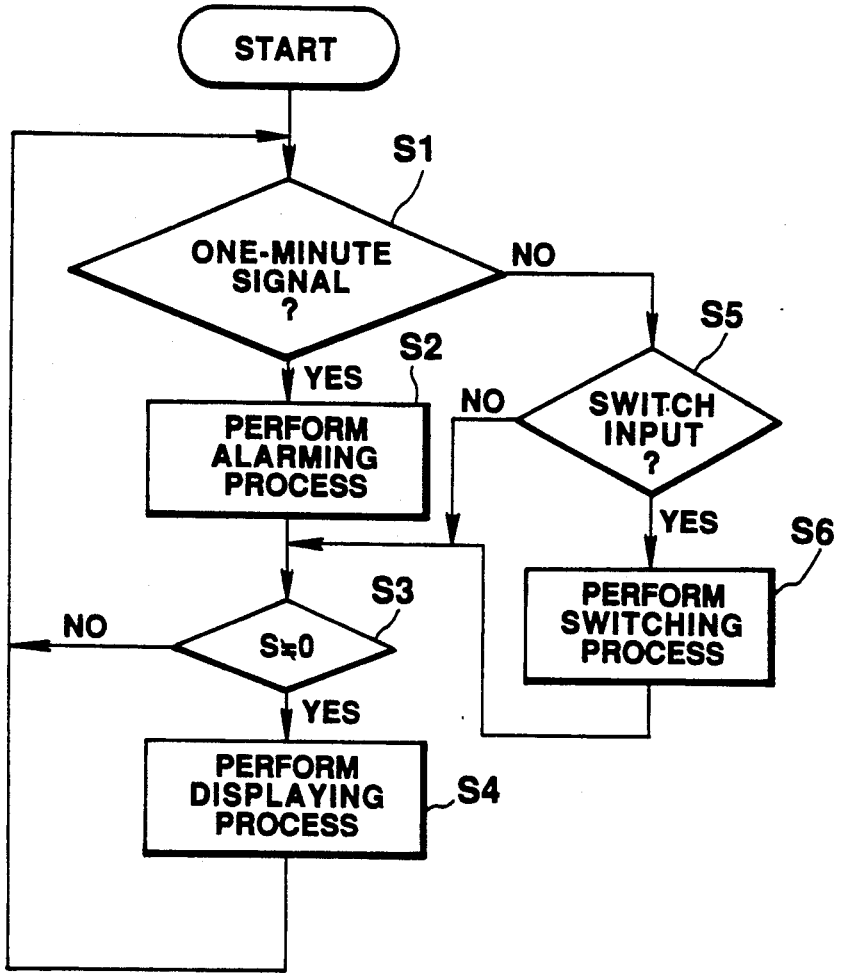
FIG. 6 is a general flow chart showing action of the circuit of FIG. 4.

The action of the electronic wrist watch of the first embodiment constructed as described above will be explained in the following. FIG. 6 is a general flow chart schematically showing the action of the electronic wrist watch of the first embodiment. In a step S1, it is determined whether one-minute signal from the time counting circuit 33 at every one minute is transmitted or not. When the one-minute signal is transmitted, an alarming process (a step S2) is executed to open and close the display window portion 7*a* and to produce an alarm sound from the buzzer 34, the alarm sound alarming arrival at the schedule time. Then, at a step S3, it is determined whether the value of the shutter position register S is 0 or not. When the value is not 0, a schedule information to be displayed at that time is displayed on the digital display portion 42 in a step S4. After this, the action returns to the step S1. When the value set in the shutter position register S is determined to be 0, the action returns directly to the step S1.

When it is determined at the step S1 that one-minute signal is not transmitted, it is checked at a step S5 whether there is a switch input by the switch portion 39 or not. If there is the switch input, a switching process corresponding to the switch input is executed in a step S6, and then the action proceeds to the step S3. If there is not the switch input, the action proceeds directly to the step S3 and then follows the above described procedures.

Figure 7:
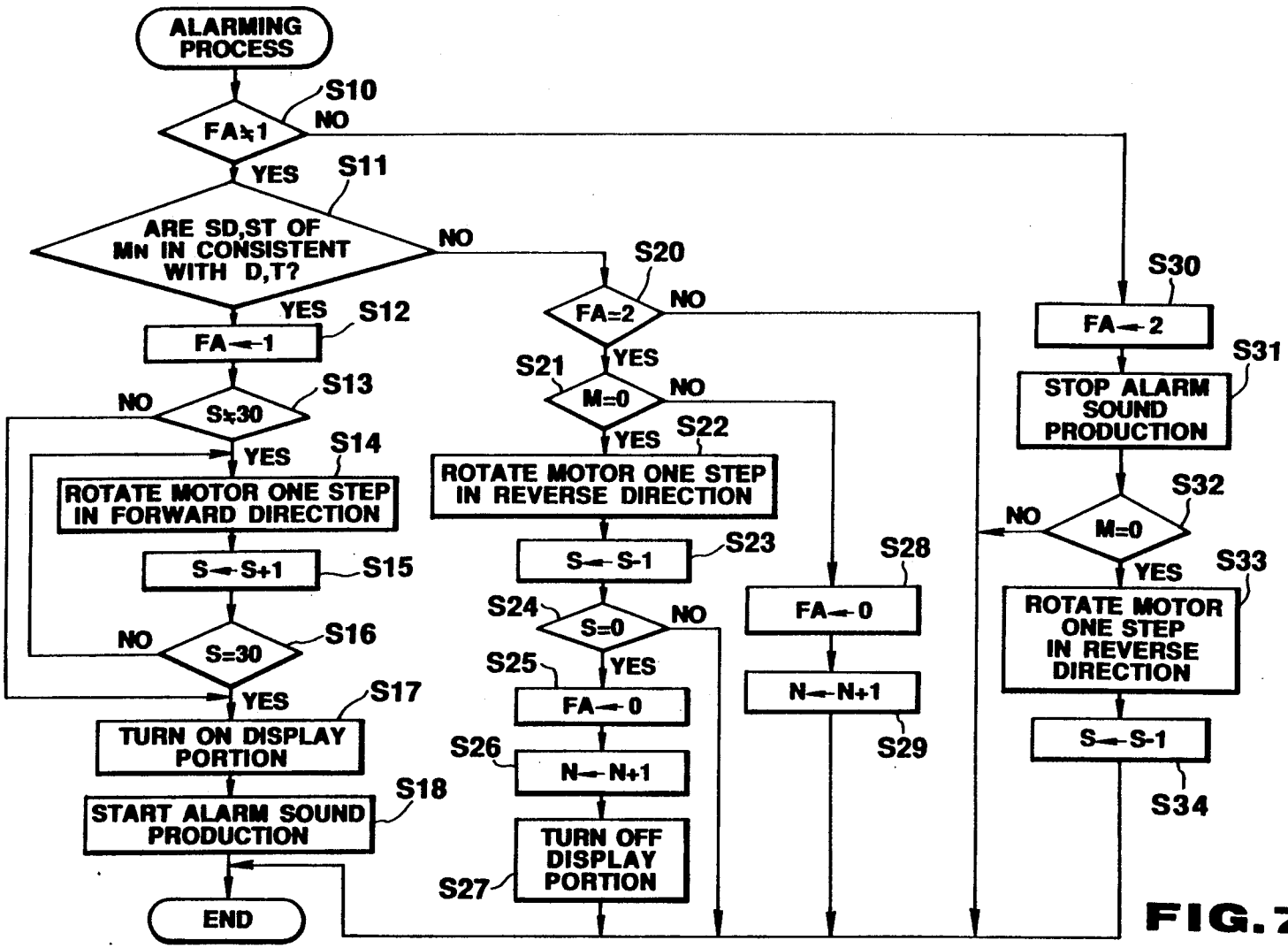
FIG. 7 is a flow chart showing an alarming process of the flow chart of FIG. 6 in detail.
Figure 8:
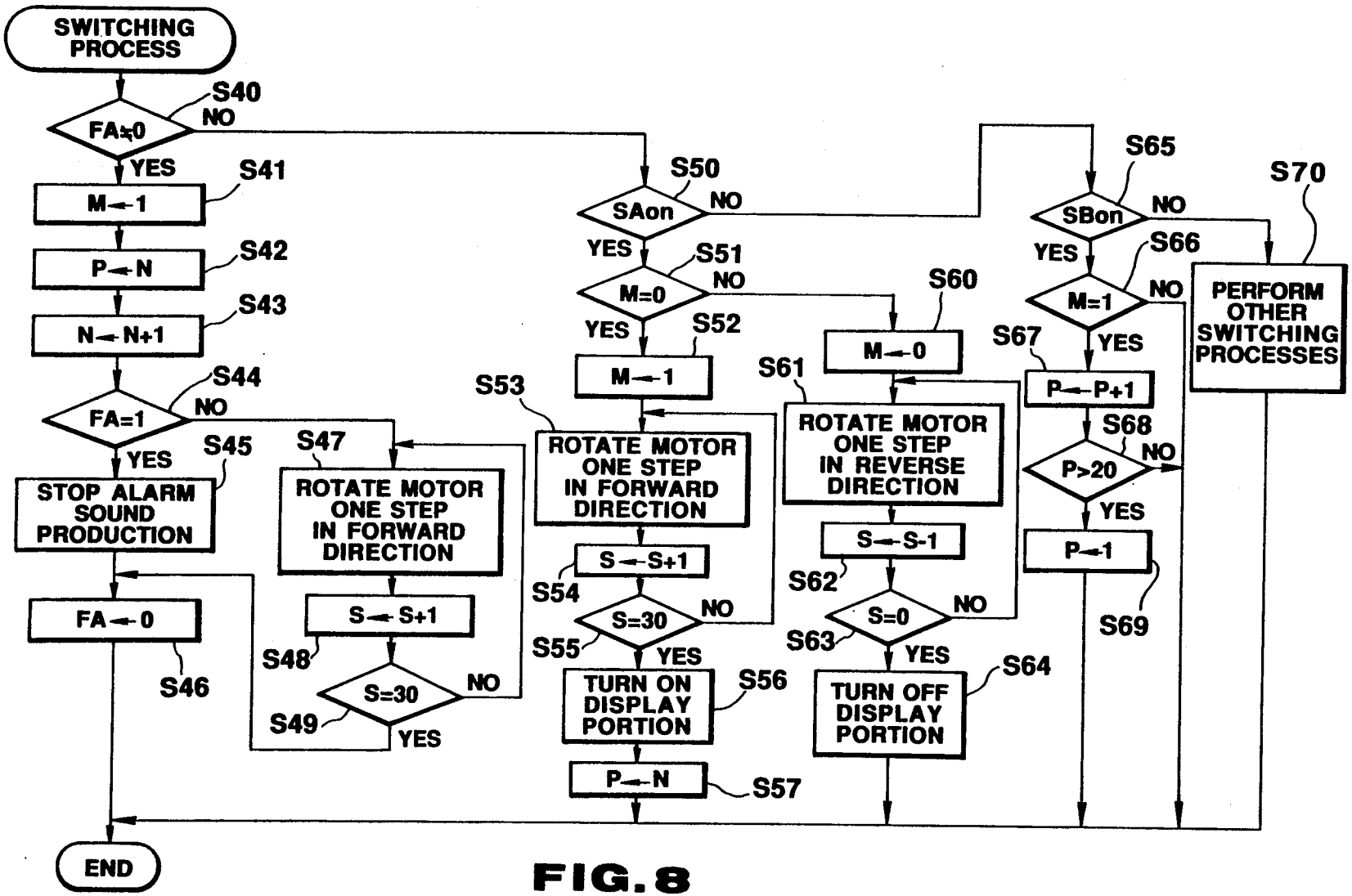
FIG. 8 is a flow chart showing a switching process of the flow chart of FIG. 6 in detail.
Figure 9:
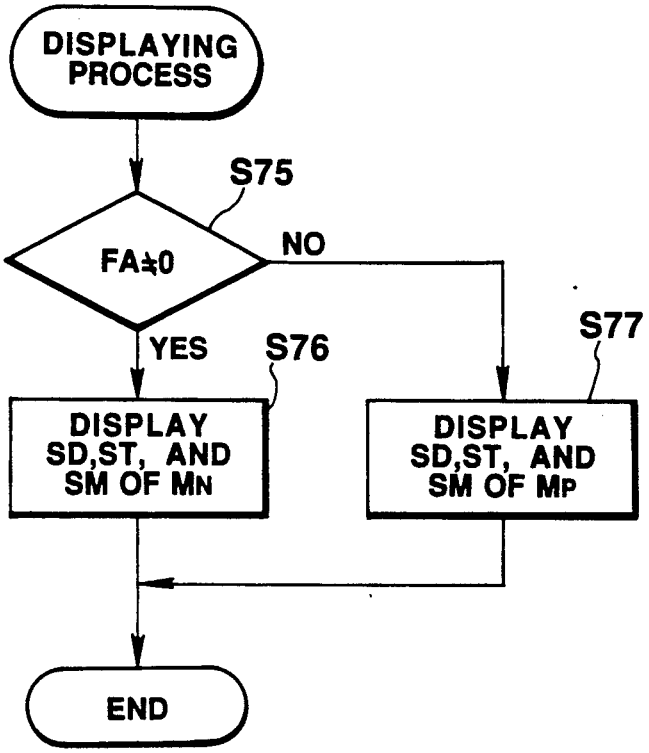
FIG. 9 is a flow chart showing a displaying process of the flow chart of FIG. 6 in detail.

FIGS. 7, 8 and 9 respectively show in detail flow charts of the alarming process (the step S2), a switching process (the step S5) and a displaying process (the step S4). The action of the electronic wrist watch will be described under various situations by referring to these flow charts.

(I) Confirmation of the schedule informations in the schedule memory portion SK

In a case that the user wants to confirm the schedule informations stored in the schedule memory portion SK by setting the schedule mode while the watch mode has been set, he or she has to operate the push button switch SA. When the switch SA is depressed, the step S6 of FIG. 6, that is a switching process of FIG. 8, is executed. In the switching process, firstly in a step S40, it is determined whether 0 is set or not in the state register FA. Since the value in the state register FA is 0, when no alarm sound is being produced nor the display window portion *7a* is being closed, the action proceeds to a step S50. In the step S50, whether the push button switch SA has been pushed or not is determined. Then in a step S51, it is determined whether 0 is set in the mode register M to select the watch mode. In this case, since the watch mode is set and M=0, the action proceeds to a step S52 where 1 is set in the mode register M to select the schedule mode. Then, at the step S53, the forward rotation signal R is sent to the motor drive circuit 40 to cause the shutter driving stepping motor 22 to rotate the shutter plate 8 in a forward direction (in a clockwise direction) by one step (or 4°). Thereafter, at a step S54, the value set in the shutter position register S is increased by one. At a step S55, it is determined whether the value set in the shutter position register S is 30 or not. When the value set in the shutter position register S is not 30, the action returns to the step S53 and the shutter driving stepping motor 22, or the shutter plate 8, is rotated forward by another step. Then, the value set in the shutter position register S is increased by one at the step 54, and it is determined again whether the value set in the shutter position register S is 30 or not. If the value set in the shutter position register S is not 30, the action returns to the step S53 to repeat the steps S53 through S55 until the value set in the shutter position register S becomes 30 and the display window portion *7a* is completely opened. In this case, as illustrated in FIG. 2, the rotation of the rotor pinion 24 of the shutter driving stepping motor 22 is transmitted to the internal wheel gear 8*b* of the shutter plate 8 through the first gear wheel 23*a*, the second gear wheel 23*b* and the third gear wheel 23*c* of the gear train mechanism 23. When the value set in the shutter position register S is 30 and hence the display window portion *7a* is fully open to make the entire surface of the liquid crystal display panel 10 clearly visible from outside, a display ON signal is sent to the display drive circuit 41 at a step S56 to drive the liquid crystal display panel 10 of the digital display portion 42. Then, in a step S57, the value in the next schedule register N, which is the column address of the next schedule stored in the schedule memory portion SK, is set in the register P.

After the above steps are completed, the action proceeds to the step S3 of FIG. 6, at which it is determined that the value set in the shutter position register S is not 0, and then further proceeds to the step S4, or a displaying process, as illustrated in FIG. 9. In a step S75 of the displaying process, it is determined whether the value set in the state register FA is 0 or not and then, in a step S77, date (SD) time (ST) and the message (SM) of the next schedule designated by the register P are displayed on the liquid crystal display panel 10.

After the next schedule displayed on the liquid crystal display panel 10 is confirmed through the fully opened display window portion *7a*, other schedules in future stored in the schedule memory portion SK can be sequentially displayed on the liquid crystal display panel 10 to confirm them by depressing the push button switch SB. At each time the push button switch SB is depressed, the depression of the push button switch SB is detected at a step S65, the value in the register P is increased successively one by one from 1 to 20 by steps S68 to 69 under the condition that it is determined in a step 66 the value of the mode register M is set at 1 designating the setting of the schedule mode. Then, the action proceeds to the step S4 of FIG. 6, or a displaying process illustrated in detail in FIG. 9, and, in the step S77, the schedule designated by the value in the register P is displayed on the liquid crystal display panel 10.

In order to set again the watch mode after the desired schedule is confirmed in a manner as described above, the push button switch SA must be depressed again. The depression of the push button switch SA is detected in the step S50 and, in the step S51, it is determined that the value set in the mode register M is not 0, or that the watch mode has not been set. Then, in a step S60, 0 is set in the mode register M to set the watch mode. Thereafter, the reverse rotation signal L is sent intermittently from the motor drive circuit 40 to the shutter driving stepping motor 22 to rotate intermittently the shutter plate 8 in a reverse direction (in a counterclockwise direction) by one step each time and to decrease the value set in the shutter position register S one by one. These actions are repeated until the value set in the shutter position register S becomes 0 and the display window portion *7a* is completely closed by the shutter plate 8 (steps S61 through S63). When the value set in the shutter position register S is 0, the action proceeds from the step S63 to a step S64, and a display OFF signal is supplied to the display drive circuit 41 to stop the display action of the liquid crystal display panel 10.

(II) Arrivals to a scheduled time under the watch mode

Now, assuming that the watch mode is set and the display window portion *7a* is completely covered by the shutter plate 8 so that the liquid crystal display panel 10 is not visible from outside. Under this condition, when it comes to a scheduled time of a schedule designated by the next schedule register N, the following action will take place. After a one-minute signal from the time counting circuit 33 is detected by the step S1 of FIG. 6, the step S2, or an alarming process illustrated in detail in FIG. 7, is executed and then, in a step S10, it is determined that the value set in the state register FA is not 1. Then, in a step S11, it is determined that the date (SD) and the time (ST) of the schedule designated by the next schedule register N of the schedule memory portion SK are consistent with the current date (D) and the current time (T) sent from the time counting circuit 33 and, in a step S12, 1 is set in the state register FA. Thereafter, in a step S13, it is determined that the value of the shutter position register S has not reached 30 yet, or that the display window portion *7a* is not fully opened. Then, the forward rotation signal R is sent to the motor drive circuit 40 to control the shutter driving stepping motor 22 to rotate its output shaft in a forward direction by one step and the value of the shutter position register S is increased by one. These actions are repeated until the value of the shutter position register S becomes 30, or the display window portion *7a* is fully opened (steps S14 through S16).

After the display window portion *7a* is fully opened as described above, a display ON signal is sent to the display drive circuit 41 to make the liquid crystal display panel 10 in a displayable condition in a step S17, then in a step S18, the buzzer 43 is operated to produce an alarm sound to notify that the current time reaches at a schedule time. Then, in the step S3 of FIG. 6, it is determined that the value of the shutter position register S is not 0, and the step S4, or the displaying process illustrated in detail in FIG. 9, is executed. In the step S75 of the displaying process, it is determined that the value of the state register FA has been already not 0 but 1 and a date (SD) and a time (ST) and a message (SM) of an incoming schedule designated by the next schedule register N are displayed on the liquid crystal display panel 10 in a step S76. For example, in a case that the above described schedule is a meeting which is held at 11 o'clock on July 5th, the liquid crystal display shows these schedule information, and the outer appearance of this embodiment is as illustrated in FIG. 1B.

If there is no switch operation during the one-minute signal has been elapsed after the contents of the schedule information which arrives at its scheduled time are displayed on the liquid crystal display panel 10 and the producing of an alarm sound starts, the alarming process (the step S2, or illustrated in detail in FIG. 7) is executed by sending out of the next one-minute signal. It is determined in the step S10 of the alarming process that the value of the state register FA is 1, and the value of the state register FA is set at 2 in a step S30, and then the producing of the alarming sound is stopped in a step S31. Further, in a step S32, it is determined whether the value of the mode register M is 0 or not. If it is not 0, the step S3 of FIG. 6 and the steps S75 and S76 of the displaying process S4 are executed. If it is determined that the value of the mode register M is 0 in the step S32 and the watch mode has been set, the CPU 30 supplies the motor drive circuit with the reverse rotation signal L in a step S33 to cause the shutter driving stepping motor to rotate at one step and therefore the shutter plate 8 rotates in a reverse direction, or in a counter-clockwise direction, by one step. Then, in a step S34, the value of the shutter register S is reduced by one, and the step S3 of FIG. 6 and the steps S75 and S76 of the displaying process S4 shown in FIG. 9 are executed.

After the alarm sound has been stopped, the alarming process is executed at each time when a one-minute signal is received, or every one minute. In the alarming process, the steps S10 and S11 are executed, and then it is determined in a step S20 that the value in the state register FA is 2 and further, in the step S21, it is determined that the value in the mode register M is 0 and therefore the watch mode is set. Then, in a step S22, the reverse rotation signal L is transmitted to the motor drive circuit 40 to control the shutter-driving stepping motor 22 to rotate the shutter plate 8 in a reverse direction by one step. In a step S24, the value in the shutter position register S is decreased by one at each time the shutter plate 8 is moved by one step. The actions executed in the step S3 of FIG. 6 and in steps S75 and S76 of the displaying process illustrated in FIG. 9 are is repeated. Consequently, the display window portion *7a* is gradually closed from left in a step-by-step manner as the shutter plate 8 is rotated reversely by 4° per minute to cover the former. Therefore, when 15 minutes have passed from the scheduled time, the right half of the display window portion *7a* is closed by the shutter plate 8 (to figure 15 printed under the display window portion *7a*), as shown in FIG. 1C. Thus, the time (the number of minutes) that has elapsed from the scheduled time can be recognized easily by the extent that the liquid crystal display panel 10 is covered by the shutter plate 8, that is by reading the figure under the right end of the exposed area of the liquid crystal display panel 10.

As described above, when 30 minutes have passed from the scheduled time, the display window portion *7a* is completely closed by the shutter plate 8 and the value in the shutter position register S becomes 0. This is detected in the step S24 and the value in the state register FA becomes 0 in a step S25. Then, in a step 26, the value in the next schedule register N is increased by 1 for designating a next schedule. In a step S27, a display OFF signal is sent to the display drive circuit 41 to stop the display action of the liquid crystal display panel 10. Then, the action returns to the step S1 via the step S3 in FIG. 6.

(III) Switching operation after arrivals to a scheduled time

If one of the press button switches SA through SD is operated when a scheduled time has come and an alarm sound is being produced or when the display window portion *7a* is being closed step-by-step during 30 minutes from the scheduled time, the embodiment acts in the following manner. The input signal generated by the operation of the press button switch is detected in the step S5 of FIG. 6 and in the step S6 of FIG. 8 a switching process starts. It is determined in the step S40 of the switching process that the value in the state register FA is 1 or 2 and not 0, or that 30 minutes have not passed from the scheduled time, and, in a step S41, the mode register is set to 1 to force a schedule mode. Then, in a step S42, the value in the next schedule register N is set in the register P, and, in a step S43, the value in the next schedule register N is increased by one. Thereafter, in a step S44, the value in the state register FA is checked. If it is found that the value is 1 and an alarm sound is being produced, the alarm sound is stopped in a step S45 and the value in the state register FA is reduced to 0 in a step S46. If it is found that the value in the state register FA is 2 and the display window portion *7a* is being gradually closed, the forward rotation signals R are sequentially sent out to cause the shutter driving stepping motor 22, and therefore the shutter plate 8, to rotate step-by-step in the forward direction until the value in the shutter position register S reaches 30 in steps S47 through S49. Each time the shutter plate 8 is rotated by one step in the forward direction, the value in the shutter position register S is increased by one.

When the value in the shutter position register S has reached 30, the value in the state register FA is reduced to 0 in the step S46.

After completion of the switching process, the action proceeds to the step S4, or a displaying process as illustrated in FIG. 9, by way of the step S3 of FIG. 6. Then, in the step S75, it is determined that the value in the state register FA is already 0 and, in the step S77, the content of the schedule of this time designated by the register P is displayed on the liquid crystal display panel 10

Once the schedule mode is set, the schedules stored in the schedule memory portion SK are sequentially displayed on the liquid crystal display panel 10 for confirmation each time the push button switch SB is depressed, just as in the case where the push button switch SA is operated to shift the watch mode to the schedule mode (the steps S65 through S69, S3, S75 and S77). When the push button switch SA is depressed, the display window portion *7a* is closed and the mode of action is returned to the clock mode (the steps S50, S51, S60 through S64, S3 and S1).

(IV) Arrivals to the schedule time under the schedule mode

Under this condition and upon receiving a one-minute signal, the action proceeds to the alarming process (the steps S1 and S2) and, if it is found that the value in the state register FA is still 0 and not 1 yet in the step S10, it is determined whether the date and time of the schedule designated by the next schedule register N are the same as the current date and time or not. If it is found in the step S11 that they are equal to each other, the value in the state register FA is made to 1 and, in the step S13, it is determined whether the value in the shutter position register S is 30 or not, or the display window portion *7a* is fully opened or not. Since the display window portion *7a* is fully opened and the value in the shutter position register S is 30 in the schedule mode, a displaying action of the liquid crystal display panel 10 is started in the step S17, and then in the step S18, an alarm sound is produced. Thereafter, the action proceeds to a displaying process (FIG. 9 or the step S4) via the step S3 of FIG. 6, it is determined in the step S75 of the displaying process S4 that the value of the state register FA is not 0 and the content of the schedule designated at this time by the next event register N is displayed on the liquid crystal display panel 10 in the step S76. When one minute has passed under this condition and the alarming process is started by the next one-minute signal, it is determined that FA is 1 in the step S10 and then in the step S30 the value in the state register FA becomes 2. In the step S31, the alarm sound is stopped, but the display window portion *7a* is not closed. Thereafter, each time a one-minute signal is received, an alarming process is executed and, after passing the steps S10, S11, S20 and S21, the value in the state register FA is reduced to 0 in a step S28. In a step S29, the value in the next schedule register N is increased by one and the action returns to a schedule mode where the content of the schedule designated by the next schedule register N is displayed on the liquid crystal display panel 10 (the steps S3, S75 and S76).

(2) Second Embodiment

Figure 10:
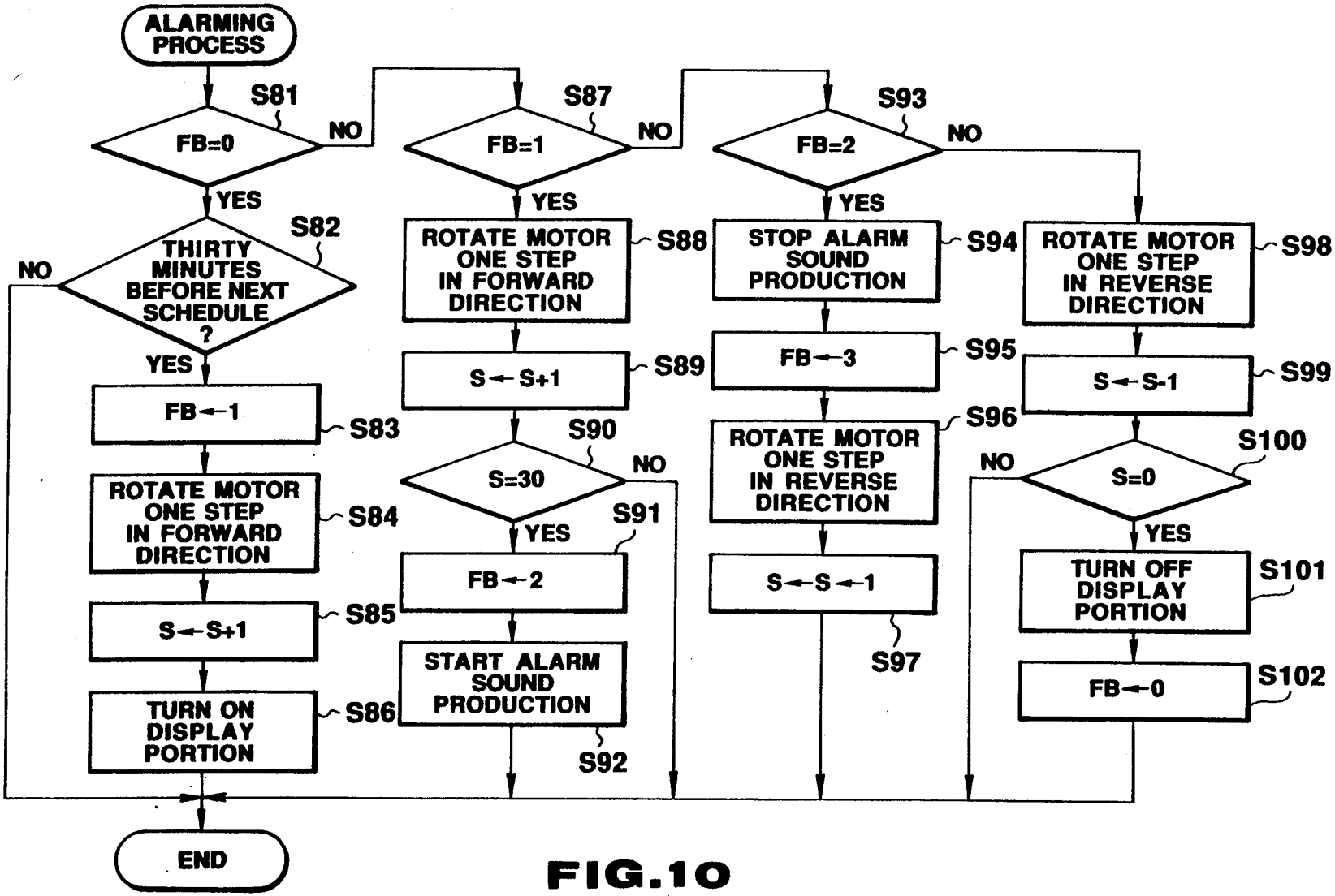
FIG. 10 is a flow chart showing an alarming process of an electronic wrist watch of a second embodiment of the invention in detail.

FIG. 10 is a flow chart for an alarming process in a second embodiment of the invention. Since the appearance, the construction and the circuit of the second embodiment are identical with those of the first embodiment except for the alarming process, they will not be described here any further.

In this second embodiment, the shutter plate starts its opening movement 30 minutes before a schedule time and then it rotates every minute by one step until the display window portion *7a* is fully opened after 30 minutes have passed. That is, at the scheduled time, the display window portion *7a* is fully opened and an alarm sound is emitted. Thereafter, the shutter plate keeps its rotation at the same pace until it completely closes the display window portion *7a* by lasping 30 minutes after the scheduled time.

The alarming process is executed at every one minute. More specifically, when an alarm state register FB is checked in a step S81, and it is found that FB is 0 and an alarm sound is not being emitted, it is determined whether the current time is 30 minutes before the next scheduled time or not. If so, the alarm state register FB is set at 1 in a step 83, and then in a step S84 the shutter driving stepping motor is controlled to rotate the shutter plate clockwise by one step. Then, in a step S85, the value in the shutter position register S is increased by one to memorize the position of the shutter plate in the shutter position register S. Thereafter, in a step S86, the displaying portion is started to display the schedule information and this alarming process is completed.

After one minute has passed and the alarming process is excited again, it is determined that the value of the alarm state register FB is not 0 and then in a step 87 it is determined that the value of the alarm state register FB is 1, so that the shutter driving stepping motor is controlled to rotate the shutter plate clockwise by one step in a step S88. In a step S89, the value of the shutter position register S is increased by one to make the position of the shutter plate correspond to the predetermined value of the shutter position register S. Finally, in a step S90 it is determined whether the value of the shutter position register S becomes 30 or not, and if it has not become 30 the alarming process is completed.

After that, the process of steps S81, S87, S88, S89 and S90 is executed at every one minute until the current time arrives at the scheduled time. In the step S90, it is determined that the value in the shutter position register S becomes 30 when the current time arrives at the scheduled time. Then, in a step S91, the value of the alarm state register FB is set at 2 and emitting of an alarm sound starts in a step S92.

Since the alarm state register FB is set at 2 when the alarming process is started again after one minute has passed, it is determined that the value of the alarm state register FB is not 0 in the step 81, further in the step 87 it is determined that the value of the FB is not 1, and in a step 93 it is determined that the value of the alarm state register FB is 2. Emitting of alarm sound is stopped in a step S94, then, in a step S95, 3 is set in the alarm state register FB. In a step S96, the shutter driving stepping motor is controlled to rotate the shutter plate counterclockwise by one step, and, in a step S97, the value in the shutter position register S is decreased by one in order to make the value of the shutter position register S be consistent with the actual position of the shutter plate. Since the value of the alarm state register FB is 3 when another alarming process is started after one minute has passed, it is determined in the step S81 that the value in the alarm state register FB is not 0, then in the step S87, it is determined that the value of the alarm state register FB is not 1 and, further in the step S93, it is determined that the value in the alarm state register FB is not 2. Thereafter, the shutter driving stepping motor is controlled to rotate the shutter plate counterclockwise by one step. Then, in a step S99, the value in the shutter position register S is decreased by one in order to make the value of the shutter position register S be consistent with the position of the shutter plate. Thereafter, in a step S100, it is determined whether the value in the shutter position register S is 0 or not. If the value is not 0, the alarming process is completed.

After that, the process of the steps S81, S87, S93, S98, S99 and S100 is repeated every minute and the shutter plate is rotated counterclockwise by one step every minute to decrease the value in the shutter position register S by one each time until 30 minutes has passed from the scheduled time. When 30 minutes have passed from the scheduled time, it is determined that the value in the shutter position register S becomes 0 in the step S100 and the display portion is turned off to stop displaying the displayed information in a step S101. Then, in a step S102, 0 is set in the alarm state register FB to terminate the alarming process.

With this embodiment, the shutter plate starts its rotation to open the display window portion 30 minutes before the scheduled time and keeps its step-by-step rotation until the display window portion is fully opened and an alarm sound is emitted at the scheduled time. Thereafter, the shutter plate still keeps its step-by-step rotation to completely close the display window portion until 30 minutes has passed from the scheduled time. With such an arrangement, both the time before the scheduled time and the time elapsed from the scheduled time can be easily recognized by the extent of opening of the display window portion.

(3) Third Embodiment

A third embodiment of the invention will now be described by referring to FIGS. 11 through 15.

Figure 11B:
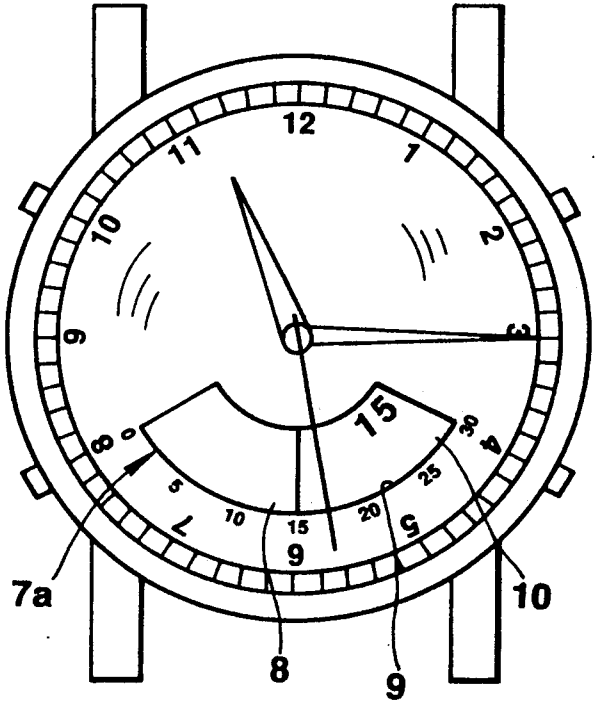
FIG. 11B is a plan view of the electronic wrist watch of the third embodiment of FIG. 11A in a condition that the shutter plate closes half of the window of the dial while a timer operates.
Figure 11A:
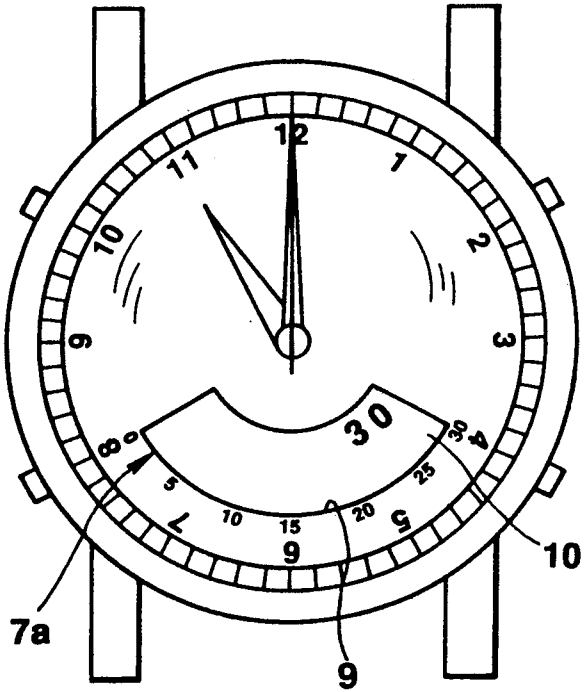
FIG. 11A is a plan view of an electronic wrist watch of a third embodiment of the invention in a condition that a shutter plate fully opens a window of a dial in timer mode.

This third embodiment is realized by adding a timer function to the first embodiment. If the timer mode is set, the display window portion *7a* is fully opened as illustrated in FIG. 11A and then set a timer time selecting one of 60 minutes, 30 minutes, 15 minutes, 10 minutes and 5 minutes. FIG. 11A shows the embodiment when the timer time of 30 minutes has just been selected. If the start switch is operated under this condition, the shutter plate 8 starts its rotation to close the display window portion *7a* in such a manner that the display window portion *7a* is completely closed by the shutter plate 8 for the selected timer time and therefore the user can recognize the time passed from the start of the timer time or the time remained in the timer time before the timer time will be completely finished. FIG. 11B shows a condition where 15 minutes have passed from the start of the timer time after 30 minutes is selected as the timer time. In this condition, the display window portion *7a* is half closed and the user can recognize the value of the time remained in the timer time before the timer time will be completely finished is one half of the preliminary set timer time. At this time, the remained time of 15 minutes is displayed by the liquid crystal display panel 10.

(a) Construction

Figure 12:
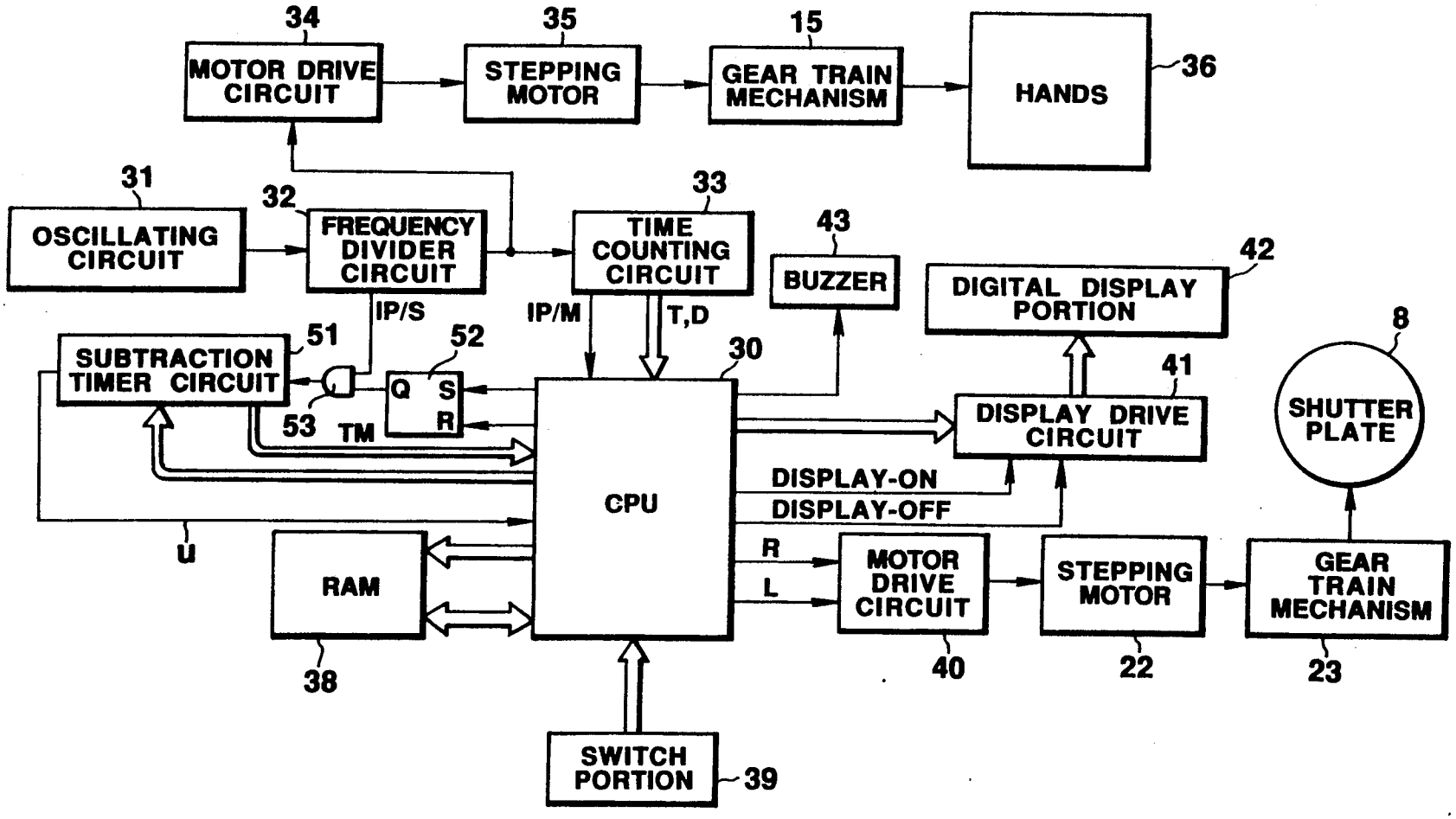
FIG. 12 is a block diagram of a circuit of the electronic wrist watch of FIG. 11A.

FIGS. 12 is a block diagram showing the circuit of the third embodiment. This circuit is realized by adding a subtraction timer circuit 51, an RS flip-flop 52 and an AND-gate 53 to the circuit of the first embodiment.

Set signals and reset signals are supplied by the CPU 30 to set a terminal S and a reset terminal R of the RS flip-flop 52. The RS flip-flop 52 supplies "1" signals from its Q output to one of the input terminals of the AND-gate 53 when it is in a set state. One-pulse per second signals (1 P/S) generated from the frequency divider circuit are supplied to the other input terminal of the AND-gate 53. The AND-gate 53 supplies 1 P/S signal to the subtraction timer circuit 51 at each time when it receives a "1" signal from the Q output of the RS flip-flop 52. The subtraction timer circuit 51 memories a timer time supplied from the CPU 30, subtracts one second from the timer time at each time when it receives 1 P/S signal from the AND-gate 53 to obtain a remaining time information TM, and supplies the remaining time information TM to the CPU 30. The subtraction timer circuit 51 supplies a time-up signal u to the CPU 30 when the remaining time becomes 0.

In this third embodiment, the RAM 38 has registers X, A and B in addition to the registers in the first embodiment. The register X is set to 0 when the time counting action of the subtraction timer circuit 51 is stopped, or when the RS flip-flop 52 is in a reset state, and it is set to 1 when the subtraction timer circuit is actuated, or when the RS flip-flop 52 is not in a reset state. The register A memories the selected one of the timer times of 60 minutes, 30 minutes, 15 minutes, 10 minutes or 5 minutes. The register B memories a shutter position corresponding to the remaining time while the remaining time being displayed by the shutter plate 8 under the condition that the timer is acting. In this embodiment, the mode register M takes a value selected from 0 to 2, and designates a watch mode and a schedule mode, as in the case of the first embodiment, when the value of the mode register M is set at 0 or 1, further designates a timer mode when the value thereof is set at 2.

(b) Action

The action of the third embodiment will be explained in the following.

Figure 13:
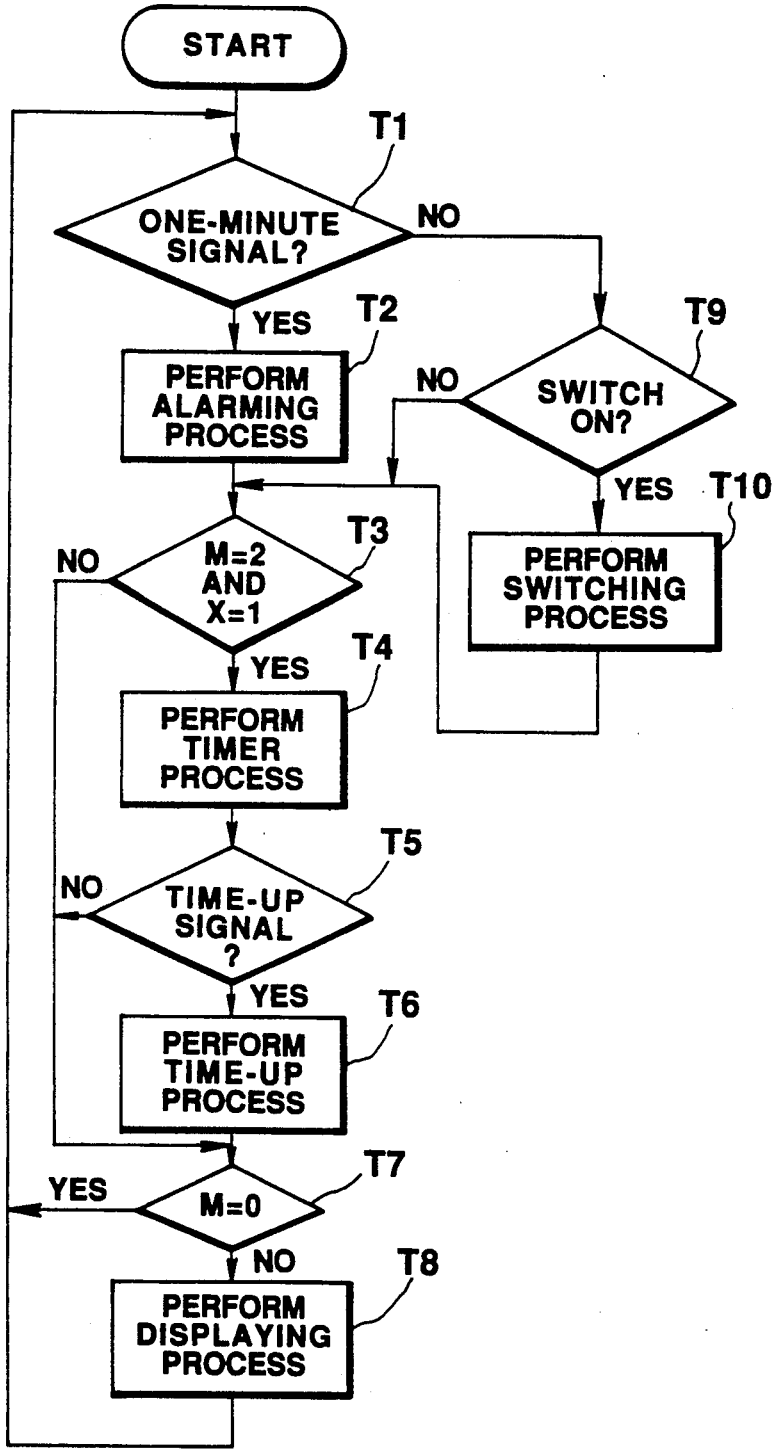
FIG. 13 is a general flow chart showing action of the circuit of FIG. 12.

FIGS. 13 is a general flow chart of the third embodiment.

In a step T1, it is determined whether a one-minute signal is supplied from the time counting circuit 33 into the CPU 30 or not. If the answer is yes, an alarming process is executed in a step T2. Since the alarming process is the same as an alarming process illustrated in FIG. 7 for the first embodiment, it will not be described here any further. When the alarming process is finished, the action proceeds to a step T3.

If it is determined in the step T1 that no one-minute signal is supplied, it is determined in a step T9 whether there is a switch input from the switch portion 39 or not. If it is found that there is the switch input, a switching process is executed in a step T10 and further the action proceeds to the step T3. If it is found in the step T9 that there is no switch input, the action proceeds directly to the step T3.

Then, in the step T3, it is determined whether 2 is set in the mode register M and 1 is set in the register X or not. In other words, only in a case that the subtraction timer circuit 51 is operating in the timer mode, a timer process is executed in a step T4 and then, in a step T5, it is determined whether the remaining time TM in the subtraction timer circuit 51 becomes 0 and a time-up signal u has been outputted or not. If it is determined that the time-up signal u has been outputted, a time-up process is executed in a step T6. Thereafter, it is determined whether the value in the register M is 0 or not, or whether the watch mode is set or not, in a step T7. If it is determined that the value in the register M is not 0 and a watch mode is not set, a displaying process is executed in a step T8. If a schedule mode is set, the date and time and the schedule message for a schedule designated by the register P in the schedule memory portion SK are displayed on the liquid crystal display panel 10, as in the case of the first embodiment. If a timer mode is set, the remaining time TM in the subtraction timer circuit 51 is displayed.

Figure 14:
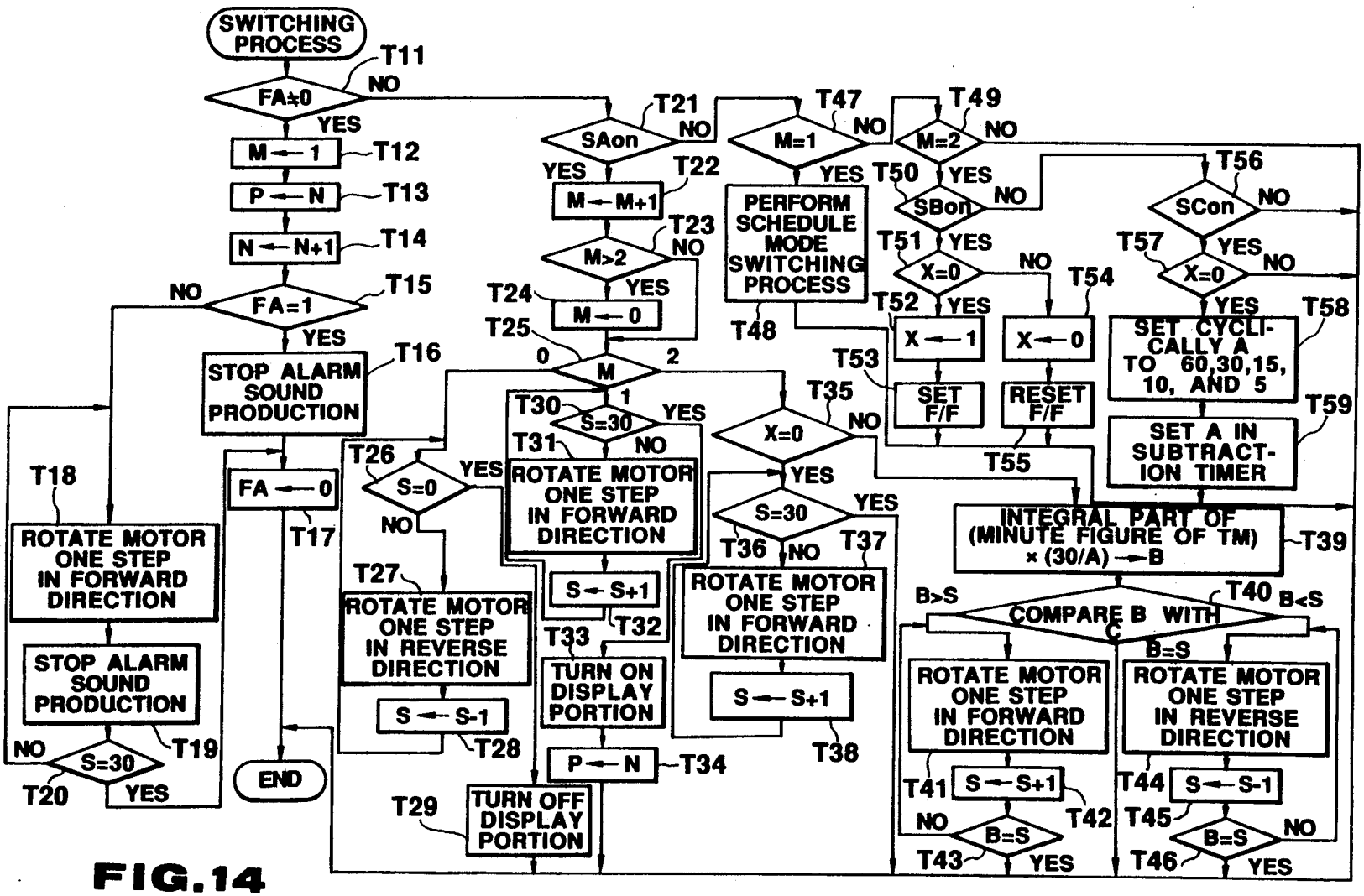
FIG. 14 is a flow chart showing a switching process of the flow chart of FIG. 13 in detail.

FIG. 14 shows in detail a switching process shown in FIG. 13. When a switch input is detected, it is determined in a step T11 that the value set in the state register FA is not 0 but 1 or 2. If the value is 1, an alarm sound is being emitted. And, if the value is 2, the shutter plate 8 is being rotates to close the display window portion *7a* and the rotational position of the shutter plate 8 is designating the time elapsed from the start if the timer time. Under the determination described above, an alarm terminating process is executed in steps T12 through T20. Since the action conducted in the steps T12 through T20 is the same as that of the steps S41 through S49 of the first embodiment, it will not be described here any further.

If the value in the register FA is 0, it is determined in a step T21 whether the switch SA has been operated or not. If the switch SA has been operated, the value in the mode register M is increased by one in a step T22 and, then, it is determined in a step T23 whether the value in the mode register M is greater than 2 or not. If the value in the mode register M is greater than 2, it is set to 0 in a step T24. In a step T25, the value of the mode register M is checked. If it is 0 and a watch mode is set, it is determined in a step T26 whether the value set in the shutter position register S is 0 and the display window portion *7a* is closed by the shutter plate 8, or not. If it is found in a step T26 that the value set in the shutter position register S is not 0, the shutter plate 8 is rotated in a reverse direction, or in a counterclockwise direction by one step, and then in a step T28 the value in the shutter position memorizing register S is decreased by one, and finally the action returns to the step T26. It is determined again in the step T26 whether the value set in the shutter position memorizing register S is 0 or not, and if the steps T27 and T28 are executed repeatedly until the value becomes 0. When the value set in the shutter position memorizing register S is 0, a display OFF signal is supplied to the display drive circuit 41 and the displaying action of the digital display section 42 is stopped.

If it is found in the step T25 that the value in the mode register M is 1 and a schedule mode is set, it is determined in a step T30 whether the value in the shutter position memorizing register S is 30 and hence the display window portion *7a* is fully opened or not. If the value in the shutter position memorizing register S is not 30, the shutter plate 8 is rotated in a forward direction, or in a clockwise direction, by one step in a step T31, and then, in a step T32, the value in the shutter position memorizing register S is increased by one, and finally the action returns to the step T30. It is determined again in the step T30 whether the value in the shutter position memorizing register S is 30 or not and, if not, the steps T31 and T32 are repeatedly executed until the value in the shutter position memorizing register S becomes 30. When the value in the shutter position memorizing register S is 30, a display ON signal is supplied to the display drive circuit 41 to drive the digital display portion 42 in a step T33, and then in a step T34 the address for nearest next schedule memorized by the next schedule register N is set in the register P.

If it is found in the step T25 that the value in the mode register M is 2 and hence the timer mode is set, it is determined in a step T35 whether the value of the register X is 0 or not or, in other words, whether the timer is stopped or not. If it is found that the value of the register X is 0 and the timer is stopped, it is determined in a step T36 whether the value in the shutter position memorizing register S is 30 and the display window portion *7a* is fully opened or not. If the value in the shutter position memorizing register S is not 30, the shutter plate 8 is rotated clockwise by one step in a step T37, then, in a step T38 the value in the shutter position memorizing register S by one, and the action returns to the step T36. It is determined again in the step T36 whether the value in the shutter position memorizing register S is 30 or not, and the steps T37 and T38 are executed repeatedly until the value in the shutter position memorizing S becomes 30.

If it is found in the step T35 that the value in the register X is 1 and hence the timer mode is being executed, a shutter position that corresponds to the present remaining time TM is determined in a step T39. In other words, the location for the number of minute in the remaining time TM in the subtraction timer circuit 51 is multiplied by the number of steps per minute, and the integer of the product is memorized in the register B. The number of steps per minute is obtained by dividing 30 steps, required for rotating the shutter from its closing position to its opening position, by the timer time set in the timer time register A. Thus, if the timer time is 60 minutes, the number of steps per minute will be 0.5 step. Similarly, 1, 2, 3 and 6 steps will be obtained respectively for 30, 15, 10 and 5 minutes of the timer times.

After the shutter position corresponding to the remaining time TM in the subtraction timer circuit 51 is stored in the register B, the shutter position that corresponds to the remaining time TM in the register B is compared with the current shutter position in the shutter position register S in a step T40. If the both positions are consistent with each other, the switching process is finished. If the value in the register B is greater than the value in the shutter position register S, the shutter plate should be further rotated to open the display window portion, or should be rotated clockwise. Therefore, the shutter plate 8 is rotated forwardly by one step in a step T41 and then in a step T42 the value in the shutter position memorizing register S is increased by one. Next, in a step T43, the value in the register B is compared again with the value in the shutter position register S. In this way, the steps T41 and T42 are repeated until the both values are consistent with each other. When the step 43 detects that the both values are consistent with each other, the shutter plate 8 is in a position that corresponds to the remaining time TM.

If the value in the register B is smaller than the value in the shutter position memorizing register S, the shutter plate should be rotated to close the display window portion, or should be rotated counterclockwise. Therefore, the shutter plate 8 is rotated reversely by one step in a step T44, and then in a step T45 the value in the shutter position memorizing register S is decreased by one. Next, in a step T46, the value in the register B is compared again with the value in the shutter position register S. In this way, the steps T44 and T45 are repeated until the both values are consistent with each other. When the value i the register B is in consistent with the value in the shutter position register S, the shutter plate 8 is in a position that corresponds to the remaining time TM.

If it is found in the step T21 that the operated switch is not the switch SA, it is determined in a step T47 whether the value in the mode register M is 1 and therefore the schedule mode is set or not. If the schedule mode is set, a schedule mode switching process as that of the first embodiment is executed in a step T48.

If it is found in the step T47 that the value in the mode register M is not 1, it is determined in a step T49 whether the value in the mode register M is 2 and the timer mode is set or not. If the value in the mode register M is 2 and the timer mode is set, it is determined in a step T50 whether the switch SB is operated or not. If it is found that the switch SB is not operated, it is determined in a step T56 whether the switch SC is operated or not. If it is found in the step T56 that the switch SC is operated, it is determined in a step T57 whether the value in the register X is 0 and the subtraction timer circuit 51 is stopped or not. If it is found that the subtraction timer circuit 51 is stopped, 60, 30, 15, 10 and 5 minutes are sequentially and cyclically set in the timer operation time register A each time the switch SC is depressed, and then, in a step T59, the timer time memorized in the timer time register A is set in the subtraction timer circuit 51.

If it is found in the step T5 that the operated switch is the switch SB, it is determined in a step T51 whether the value in the register X is 0 or not. If the value in the register X is 0 and the subtraction timer circuit 51 is stopped, 1 is set in the register X in a step T52, and then in a step T53, the RS flip-flop 52 is set to supply one-second signals generated from the frequency divider circuit to the subtraction timer circuit 51 so that the latter starts its subtraction action. If it is found in the step T51 that the value in the register X is 1 and the subtraction timer circuit 51 is acted, 0 is set in the register X in a step T54, and then in a step T55 the RS flip-flop is reset to step the action of the subtraction timer circuit 51.

Figure 15:
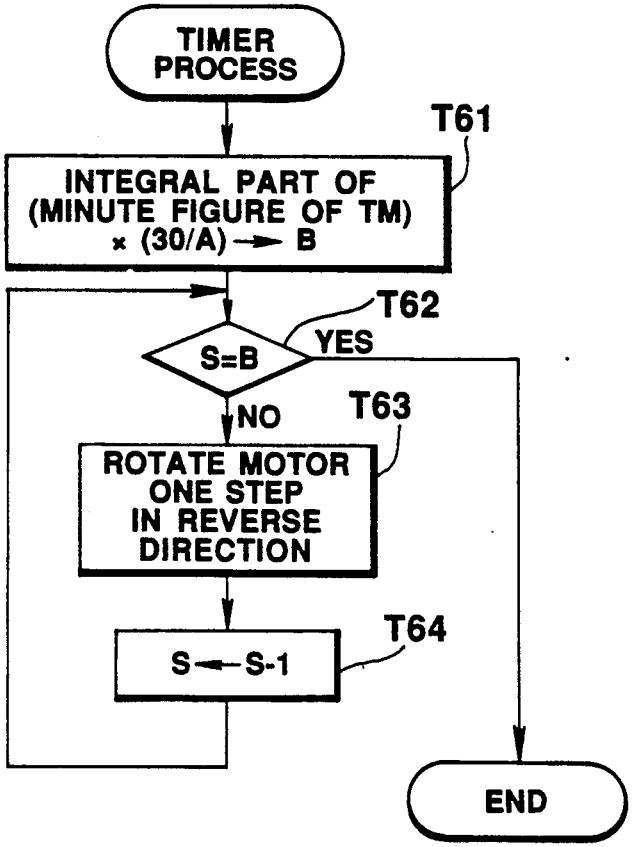
FIG. 15 is a flow chart showing a timer operation of the flow chart of FIG. 13 in detail.

FIG. 15 shows a timer process in detail. In the timer process, the shutter position corresponding to the current remaining time TM is determined and stored in the register B in a step T61, as in the step T39 for a switching process described earlier. Thereafter, the value in the register B is compared with the value in the shutter position register S in a step T62, and, if the both values are not consistent with each other, the shutter plate 8 is rotated reversely by one step in a step T63. Then, in a step T64, the value in the shutter position memorizing register S is decreased by one and the action returns to the step T62. In the step T62, the value in the register B is compared again with the value in the shutter position register S. In this manner, the steps T63 and T64 are executed repeatedly until the both values become equal to each other. When it is found in the step T62 that the value in the register B is consistent with the value in the shutter position register S, the timer process is terminated.

In the third embodiment, if a timer is set, the shutter plate rotates from its open position where the display window portion is fully opened to its closed position where the display window portion is completely closed within the timer time after the timer starts. Therefore, the remaining time to the end of the timer time can be recognized simply by the position of the shutter plate, so that the shutter plate and the shutter plate driving device can be effectively utilized.

Though, in the above described embodiments, the electro-optical display device is arranged below the opening of the dial and the opening is usually closed by the shutter plate but is opened at a preset time to make the alarm information displayed on the display device be visible, it may be possible to arrange a loudspeaker in place of the display device below the opening of the dial to voice a scheduled information at the preset time.

Further, a display board for unchangeably displaying data, for example a telephone-number printed board on which various telephone numbers are printed, may be arranged below the opening of the dial and the shutter plate may be moved to open the opening to make the data on the display board be visible.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An analog electronic watch with an electro-optical display device, comprising:

a dial provided with a window;

means for indicating a current time by rotating hands on said dial;

electro-optical display means, arranged below the window of said dial, for displaying an alarm information;

a shutter plate, movably arranged between said dial and said electro-optical display means, for opening and closing the window of said dial; and means for controlling the movement of said shutter plate to expose said electro-optical display means through the window of said dial at a preset time.

2. An analog electronic watch according to claim 1, wherein the alarm information to be displayed on said electro-optical display means is the preset time.

3. An analog electronic watch according to claim 1, wherein said electronic watch further comprises memory means for storing the alarm information, and the alarm information stored in said memory means includes the preset time and a message.

4. An analog electronic watch according to claim 1, wherein said shutter plate is rotatable around the center of rotation of said hands.

5. An analog electronic watch according to claim 1, wherein said shutter plate controlling means includes:

a stepping motor for rotating said shutter plate;

a shutter position memorizing register for memorizing a value corresponding to the extent of the movement of said shutter plate to open the window of said dial;

shutter position moving means for supplying a drive pulse having a predetermined cycle to said stepping motor at the preset time, and for changing the value stored in said shutter position memorizing register with a predetermined value at the predetermined cycle; and movement stopping means for stopping the action of said shutter position moving means when the value in said shutter position memorizing register becomes to a specified value.

6. An analog electronic watch according to claim 1, wherein said electronic watch further comprises timer time setting means for setting a timer time, and remaining-time display control means for moving said shutter plate between its full closed position at which it completely closes the window of said dial and its full opening position at which it fully opens the window within the timer time set in said timer time setting means, and for displaying the remaining time left for the timer time.

7. An analog electronic watch with an electro-optical display device, comprising:

a dial provided with a window;

means for indicating a current time by rotating hands on said dial;

electro-optical display means, arranged below the window of said dial, for displaying an alarm information;

a shutter plate, movably arranged between said dial and said electro-optical display means, for opening and closing the window of said dial;

a manually operable switch to be operated for presetting time;

first means for controlling the movement of the shutter plate so as to expose said electro-optical display means through the window of said dial when said manually operable switch is operated; and second means for controlling the movement of the shutter plate so as to expose said electro-optical display means through the window of said dial at the preset time.

8. An analog electronic watch according to claim 7, wherein the alarm information to be displayed on said electro-optical display means is the preset time.

9. An analog electronic watch according to claim 7, wherein said electronic watch further comprises memory means for storing the alarm information, and the alarm information stored in said memory means includes the preset time and a message.

10. An analog electronic watch according to claim 7, wherein said shutter plate is rotatable around the center of rotation of said hands.

11. An analog electronic watch according to claim 7, wherein said electronic watch further comprises timer time setting means for setting a timer time, and remaining-time display control means for moving said shutter plate between its full closed position at which it completely closes the window of said dial and its full opening position at which it fully opens the window within the timer time in said timer time setting means, and for displaying the remaining time left for the timer time.

12. An analog electronic watch with an electro-optical display device, comprising:

a dial provided with a window;

means for indicating a current time by rotating hands on said dial;

electro-optical display means, arranged below the window of said dial, for displaying an alarm information;

a shutter plate, movably arranged between said dial and said electro-optical display means, for opening and closing the window of said dial; and means for controlling the movement of said shutter plate to fully opening the window of said dial and to expose said electro-optical display means through the window at a preset time, and to move said shutter plate by a specified amount with a predetermined cycle and to close the window of said dial within a specified time after the preset time has passed.

13. An analog electronic watch according to claim 12, wherein the alarm information to be displayed on said electro-optical display means is the preset time.

14. An analog electronic watch according to claim 12, wherein said electronic watch further comprises memory means for storing the alarm information, and the alarm information stored in said memory means includes the preset time and a message.

15. An analog electronic watch according to claim 12, wherein graduations for indicating an elapsed time from the preset time are mounted on said dial at a portion near to the window.

16. An analog electronic watch according to claim 12, wherein said shutter plate is rotatable around the center of rotation of said hands.

17. An analog electronic watch according to claim 12, wherein said shutter plate moving control means includes:

a stepping motor for rotating said shutter plate;

a shutter position memorizing register for memorizing a value corresponding to the extent of the movement of said shutter plate to open the window of said dial;

shutter position moving means for supplying a drive pulse having a predetermined cycle to said stepping motor at the preset time, and for changing the value stored in said shutter position memorizing register with a predetermined value at the predetermined cycle; and movement stopping means for stopping the action of said shutter position moving means when the value in said shutter position memorizing register becomes a specified value.

18. An analog electronic watch according to claim 12, wherein said electronic watch further comprises manually operable switches, and said shutter plate movement control means includes shutter plate opening control means for stopping the movement of said shutter plate to close the window of said dial and for moving said shutter plate to fully open the window of said dial, when said manually operable switches are operated.

19. An analog electronic watch according to claim 12, wherein said electronic watch further comprises a manually operable switch for presetting the preset time, and shutter plate moving control means for controlling the movement of the shutter plate to expose said electro-optical display means through the window of said dial when said manually operable switch is operated.

20. An analog electronic watch according to claim 12, wherein said electronic watch further comprises timer time setting means for setting a timer time, and remaining-time display control means for moving said shutter plate between its full closed position at which it completely closes the window of said dial and its full opening position at which it fully opens the window within the timer time set in said timer timer setting means, and for displaying the remaining time left for the timer time.

21. An analog electronic watch with an electro-optical display device, comprising:

a dial provided with a window;

means for indicating a current time by rotating hands on said dial;

electro-optical display means, arranged below the window of said dial, for displaying an alarm information;

a shutter plate, movably arranged between said dial and said electro-optical display means, for opening and closing the window of said dial; and means for moving said shutter plate by a specified amount with a predetermined cycle from a specified time before a preset time to fully open the window of said dial at the preset time.

22. An analog electronic watch according to claim 21, wherein the alarm information to be displayed on said electro-optical display means is the preset time.

23. An analog electronic watch according to claim 21, wherein said electronic watch further comprises memory means for storing the alarm information, and the alarm information stored in said memory means includes the preset time and a message.

24. An analog electronic watch according to claim 21, wherein said electronic watch further comprises shutter plate closing movement control means for moving the shutter plate by a specified amount with a predetermined cycle so as to close the window of said dial within a specified time.

25. An analog electronic watch according to claim 21, wherein graduations for indicating an elapsed time from the preset time are mounted on said dial at a portion near to the window.

26. An analog electronic watch according to claim 21, wherein said shutter plate is rotatable around the center of rotation of said hands.

27. An analog electronic watch according to claim 21, wherein said shutter plate moving control means includes:

a stepping motor for rotating said shutter plate;

a shutter position memorizing register for memorizing a value corresponding to the extent of the movement of said shutter plate to open the window of said dial;

shutter position moving means for supplying a drive pulse having a predetermined cycle to said stepping motor at the preset time, and for changing the value stored in said shutter position memorizing register with a predetermined value at the predetermined cycle; and movement stopping means for stopping the action of said shutter position moving means when the value in said shutter position memorizing register becomes a specified value.

28. An analog electronic watch with an electro-optical display device, comprising:

a dial provided with a window;

means for indicating a current time by rotating hands on said dial;

a shutter plate, movably arranged under said dial, for opening and closing the window of said dial; and means for controlling the movement of said shutter plate to open the window of said dial at a preset time.

29. An analog electronic watch according to claim 28, wherein said shutter plate is rotatable around the center of rotation of said hands.

30. An analog electronic watch according to claim 28, wherein said shutter plate controlling means includes:

a stepping motor for rotating said shutter plate;

a shutter position memorizing register for memorizing a value corresponding to the extent of the movement of said shutter plate to open the window of said dial;

shutter position moving means for supplying a drive pulse having a predetermined cycle to said stepping motor at the preset time, and for changing the value stored in said shutter position memorizing register with a predetermined value at the predetermined cycle; and movement stopping means for stopping the action of said shutter position moving means when the value in said shutter position memorizing register becomes to a specified value.

31. An analog electronic watch according to claim 28, wherein said electronic watch further comprises timer time setting means for setting a timer time, and remaining-time display control means for moving said shutter plate between its full closed position at which it completely closes the window of said dial and its full opening position at which it fully opens the window within the timer time set in said timer time setting means, and for displaying the remaining time left for the timer time.

32. An analog electronic watch according to claim 28, wherein said electronic watch further comprises manually operable switches, and said shutter plate movement control means includes shutter plate opening control means for stopping the movement of said shutter plate to close the window of said dial and for moving said shutter plate to fully open the window of said dial, when said manually operable switches are operated.

33. An analog electronic watch according to claim 28, wherein said electronic watch further comprises shutter plate closing movement control means for moving the shutter plate by a specified amount with a predetermined cycle so as to close the window of said dial within a specified time.

* * * * *